US006977330B2

(12) United States Patent
Santa Cruz et al.

(10) Patent No.: US 6,977,330 B2
(45) Date of Patent: Dec. 20, 2005

(54) FINGER RING AND PICK IN COMBINATION FOR PLAYING A MUSICAL INSTRUMENT

(76) Inventors: Cathy D. Santa Cruz, 7630 Tholl Dr., Reno, NV (US) 89506; Paul A. Squillante, 18115 Northridge Ave., Reno, NV (US) 89506

( * ) Notice: Subject to any disclaimer, the term of this patent is extended or adjusted under 35 U.S.C. 154(b) by 49 days.

(21) Appl. No.: 10/696,655

(22) Filed: Oct. 30, 2003

(65) Prior Publication Data

US 2005/0092158 A1 May 5, 2005

(51) Int. Cl.[7] ..... G10D 3/16
(52) U.S. Cl. ..... 84/322; 84/320
(58) Field of Search ..... 84/322, 320, 321, 84/329

(56) References Cited

U.S. PATENT DOCUMENTS 3,181,410 A * 5/1965 Phillips ..... 84/322
4,137,814 A * 2/1979 Rowley ..... 84/322
5,837,913 A * 11/1998 Newman ..... 84/329
6,186,858 B1 * 2/2001 Cotoia ..... 446/250

* cited by examiner

*Primary Examiner*—Kimberly Lockett

(57) ABSTRACT

Herein disclosed is a finger ring interconnected to a pick in combination, each of which may be removably yet fixedly interconnected together by a tether. We provide various embodiments and/or accessory options, including use of a magnet for attaching the device onto a metallic surface when not in use and/or the tether is retractable within the ring if so desired.

11 Claims, 1 Drawing Sheet

FINGER RING AND PICK IN COMBINATION FOR PLAYING A MUSICAL INSTRUMENT

FIELD OF THE INVENTION

The present invention relates in general to "picks" that are typically used for strumming an instrument but more particularly pertains to a pick that is removably attached onto a finger ring by a tether, or the like.

BACKGROUND OF THE INVENTION

Through history many different types of stringed instruments have developed and are typically played by picking, plucking or strumming the instrument strings to produce the desired musical sounds. For example, musical instruments in general use today such as guitars, mandolins or the like employ a number of tightly tensioned strings which are formed of various materials and which are pulled to precise tensions to achieve the desired range of musical note vibratory frequencies.

Most musicians when playing a stringed instrument utilize their fingers or thumbs to pick or strum the instrument strings, by far the most common style of playing such instruments involves the use of a device generally known as a "pick" to play the instrument. In essence, the musician uses the pick to either pluck or strum across one or more strings to induce vibrations of the string that results in musical sound. Through the years, variously shaped pick devices have been addressed but there is still a need for improvement not only in the style of the pick but also in the general function and use thereof. However, the most common type of pick is that which is generally referred to as a guitar pick which defines a substantially thin planar member having a generally triangular shape with rounded comers. Such picks are made of different materials that range from inexpensive plastic to highly exotic and valuable precious metal in accordance with the user's preference.

Because the task of holding the pick while energetically playing a stringed instrument is often difficult, various aids for string instrument musicians have been devised. For example, U.S. Pat. No. 4,137,814 issued to Rowley sets forth a NONSLIP GUITAR PICK having a palm piece attached to a pick by means of a flexible connection whereby the palm piece and flexible connection cooperate to prevent the guitar pick from rotating in the user's grasp or slipping entirely from the user's hand.

Another similar device is taught in U.S. Pat. No. 6,118,058 wherein taught is a finger ring and guitar pick coupled by a flexible chain. In use, the musician wears the finger ring upon the desired finger and holds the guitar pick between the thumb and forefinger with the flexible chain stretched there between. This is somewhat functional for its intended use but it is much too complicated, uses many parts, and the chain is much too cumbersome, which in turn is most frustrating.

U.S. Pat. No. 557,293 issued to Wahl sets forth a HOLDER FOR MANDOLIN PICKS having a finger ring supporting an extending beam element which in turn supports a flexibly mounted mandolin pick. In use, the musician secures the ring to a convenient portion of the musician's finger and grasps the flexibly mounted mandolin with the fingers and thumb of the musician's hand.

While the foregoing described prior art devices have provided some assistance in aiding musicians playing stringed instruments, they are subject to several limitations and problems that the present invention addresses and resolves in a manner heretofore not taught. For example, it is commonplace for most picks to break after some use and musicians generally prefer to carry a backup pick in order to continue playing. Because the above-described prior art devices are somewhat costly and cumbersome, they discourage the practice of carrying extra picks thereby limiting the musician's security. In addition, the prior art devices fail to recognize that the frequently breaking pick portion of their various combinations is usually the least expensive portion of the apparatus. As a result, a somewhat costly device provided by such prior art structures must be replaced in its entirety as a result of the small inexpensive component of the pick having broken. This greatly increases the cost to the user.

There arises, therefore, a continuing and unfulfilled need in the art for an improved musical instrument pick which provides the convenience and use of chain-supported or tethered picks while overcoming the cost and practical disadvantages associated with the prior art devices.

SUMMARY OF THE INVENTION

Accordingly, it is a general object of the present invention to provide an improved musical instrument pick. It is a more particular object of the present invention to provide an improved musical instrument pick having finger attachment means which readily accommodate the breaking and replacement of the pick portion of the combination structure. It is a further object of the present invention to provide an improved musical instrument pick having finger attachment means which facilitates the interchange of different finger attachment rings and/or picks as the user desires.

It is another object of the present invention to provide a finger ring and pick in combination that allows the musician to easily use the pick while playing but also is non-intrusive when the pick is not being used.

Still another object of the present invention is to provide a finger ring and pick in combination that is of simple construction and inexpensive to manufacture and sell.

Yet another object of the present invention is to provide a finger ring and pick in combination that, within one possible embodiment allows the tether to be retracted into the ring itself when not in use.

Also a further object is to provide a finger ring and pick in combination wherein the tether there between is easily attached or removed to either the ring or the pick.

Yet another object of the present invention is to provide a finger ring and pick in combination that may be formed from fluorescent materials so as to be aesthetically pleasing and also glow in the dark.

Still another object of the present invention is to provide a finger ring and pick in combination that allows the musician to attach multiple picks thereon simultaneously if so desired. Thus each of the picks may have different sound characteristics so as to allow the musician to have each of the picks within grasp without the worry of losing a pick or disrupting the musician's flow while playing.

Another object of the present invention is to provide a finger ring and pick in combination that may also include a magnet thereon. Thus, when not in use, the musician can easily magnetically position and attach the device onto a metallic surface for storage purposes. For example, the user may wish to store the device on a metallic part of their guitar or the like, which is most convenient.

Also another object of the present invention is to provide a finger ring and pick in combination wherein the ring may be adjustable in size if so desired.

Other objects and advantages will be seen when taken into consideration with the following drawings and specification.

DETAILED DESCRIPTION OF THE DRAWINGS

Referring now in detail to the drawings wherein like characters refer to like elements throughout the various views. The present invention teaches a finger ring (10) interconnected to a pick (12) via a tether (14) in combination for playing a musical instrument, respectively.

Figure 1:
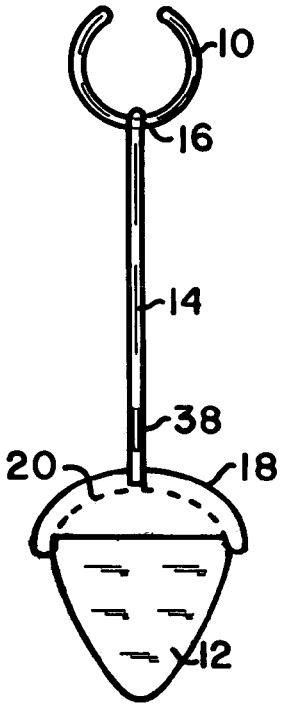
FIG. 1 is substantially an overview for a first embodiment for the present invention.

The general overall structure of the device includes the finger ring (10) that clearly defines a finger-receiving receptacle there through. It is to be noted any suitable type of ring can be used, for example the ring may be formed into a complete circle and sized to fit, or it may be adjustable such as depicted in FIG. 1. Wherein the ring (10) when manually gently squeezed molds to the users finger in an adjustable manner. The same is true for the tether as it can be made from numerous materials of engineering choice as well, such as either fishing line filament, cloth, string, elastic, rubber, wire, plastic, etc. The tether (14) has a first end and a second end, with the first end being removably attached by a first attachment means onto the finger ring (10) and the second end being removably attached by a second attachment means onto the pick (12). Whereby, within each of the embodiments depicted herein, the finger ring (10), the pick (12), and the tether (14) are interconnected yet removably attached together. It is to be understood there are many variables when considering the actual construction and manufacturing materials suitable for producing the present invention, thus the following various embodiments and/or attachment means are only exemplary of some possible alternatives.

Referring now to FIG. 1, wherein we will now more clearly define the previously noted first attachment means. As depicted therein, one embodiment for the first attachment means includes the first end of tether (14) having an opening (16) for slidably receiving the finger ring (10) there through. It is to be noted any type of opening which allows the finger ring (10) to be slidably inserted there through is satisfactory and inherent.

Figure 2:
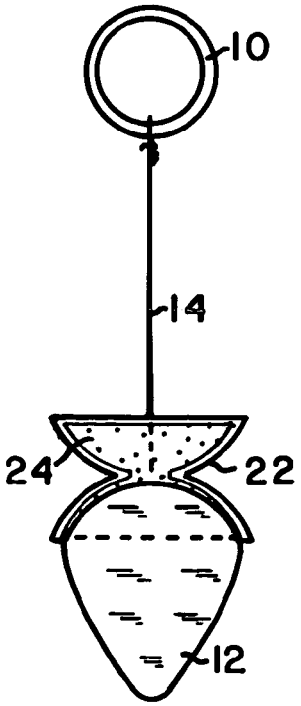
FIG. 2 is substantially an overview for a second embodiment for the present invention.

Another type of suitable first attachment means is depicted in FIG. 2. Wherein the first end of the tether (14) is simply manually tied onto the finger ring (10). This is most advantageous as a simple knot such as the type used when tying a fishing hook onto a fishing line is most efficient and functional.

Referring now to the previously noted second attachment means such as depicted in FIG. 1. Wherein the second attachment means includes the second end of tether (14) being attached onto a gripping member (18). The gripping member having an internal triangular shaped recess (20, which is depicted in ghost lines) and which is of a shape and size to substantially mate with a corner of pick (12), such as clearly illustrated in FIG. 1. Thus, when the corner of pick (12) is inserted into recess (20), recess (20) frictionally receives and retains the corner of pick (12) therein in a secure yet removable manner. Again, it is to be understood that the gripping member (18) may be made from any suitable materials of engineering choice, such as plastic, Nylon, rubber, or the like. Also the gripping member may be attached onto tether (14) by any suitable attachment means such as glue or the like. It is to be noted this embodiment not only functions for attaching the pick, but also functions as thumb rest, respectively, and provides the musician with increased friction thus resulting in a better grip on the pick.

Referring now to FIG. 2, wherein we depict a different type of second attachment means, including the second end of tether (14) being attached onto a fastening pad (22). The fastening pad (22) having a first side and a second side with the first side having a removable adhesive strip (24) which when removed leaves an adhesive residue thereon for attaching the fastening pad (22) onto a corner or section of pick (12). It is to be noted the fastening pad (22) can be of any suitable shape or size depending on engineering choice. However, it is believed that a fastening pad that is butterfly shaped, respectively, having a first wing and a second wing is most efficient. Whereby, when the adhesive strip (24) is removed and the corner of pick (12) is positioned in between each wing with the first wing being folded over onto the corner of the pick and the second wing, the pick is held there between in a secure manner by the fastening pad (22) and the adhesive residue.

Figure 3:
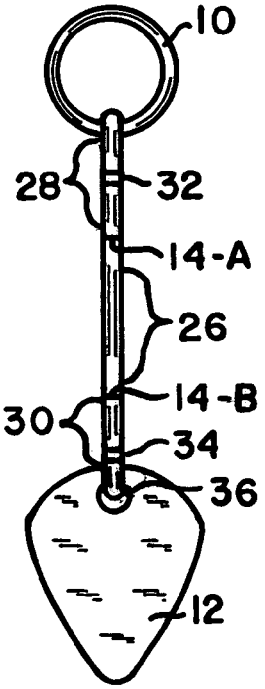
FIG. 3 is substantially an overview for a third embodiment for the present invention.

Referring now to FIG. 3 in which we provide yet a different type of first and second attachment means. Wherein, the first attachment means includes the tether (14) further having a central area (26), a first intermediate area (28), and a second intermediate area (30). The first intermediate area (28) being located between the first end referenced by (14-A) and the central area (26) and includes a first fastener (32) thereon. To assemble, the first end (14-A) after being inserted into and throughout the finger-receiving receptacle within ring (10) substantially forms a loop for attaching the finger ring (10) thereon and the first end (14-A) is then secured in place by the first end being slidably engaged within the first fastener. The above noted first attachment means can be used independently such as in combination with either gripping member (20), the fastening pad (22), or combined with the following second attachment means which is substantially the same such as depicted in FIG. 3.

As noted above the second attachment means includes the tether (14) further having a central area (26), a first intermediate area (28), and a second intermediate area (30). The second intermediate area (30) being located between the second end referenced by (14-B) and the central area (26) and includes a second fastener (34) thereon. To assemble, the second end (14-B) after being inserted into and throughout an aperture (36) provided on pick (12) substantially forms a loop for attaching the pick (12) thereon and the second end (14-B) is then secured in place by the second end being slidably engaged within the second fastener (34). Thus in this embodiment the entire tether is variably adjustable in length which is most advantageous.

It is to be understood the second attachment means may again simply include the user manually tying the second end (14-B) onto the pick (12) via aperture (36), respectively, if preferred.

It is to be understood the above noted fasteners (32 & 34) can be any type of suitable fastener of engineering choice, such as buttons, snaps, loop and pile, etc., or as depicted herein they are simply fabricated loops.

As an option or accessory item, the tether (14) may further include a magnet (38) thereon that can be positioned at any location of choice, such as depicted in FIG. 1. Whereby, magnet (38) allows a user to magnetically attach finger ring (10) with attached pick (12) onto a metallic surface, respectively, for storage purposes when not in use. For example, the musician may wish to attach the invention onto their instrument, such as a guitar or the like when not playing.

Figure 4:
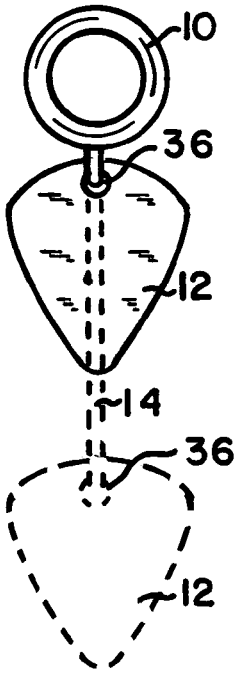
FIG. 4 is substantially an overview for a fourth embodiment for the present invention.

Yet another alternative embodiment is depicted in FIG. 4, wherein the invention further includes tether (14) being retractable within finger ring (10) between a retracted position and a non-retracted position, the latter being shown in ghost lines. Whereby, in use the user pulls tether (14) until the tether is the desired length, thereafter when manually released automatically assumes a locked non-retracted position. Whereby, thereafter, when the user initiates a gentle tug on tether (14), the tether is automatically released and assumes the retracted position. It is to be understood the actual mechanics for the retraction means is not taught herein as such retraction means are very well known within the prior art. For example, one suitable type of retraction means is the type that is typically associated with "tape-measurers" or the like. Wherein the user pulls the tape to the desired length after which it can be manually locked in place or it can automatically lock, depending on the type. Thereafter, when a gentle tug is initiated upon the tape (or in this case the tether) it automatically retracts. This is most advantageous and provides unusual results not heretofore taught.

It will now be seen we have herein provided a new and novel finger ring interconnected to a pick in combination for playing a musical instrument. Wherein, we provide different embodiments for interconnecting the individual components and we also provide various options and/or accessories for use therewith.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

What is claimed is:

1. A finger ring interconnected to a pick in combination for playing a musical instrument comprising: a finger ring which defines a finger-receiving receptacle there through; a tether having a first end and a second end; and a pick; said first end being removably attached by a first attachment means onto said finger ring, and said second end being removably attached onto said pick by a second attachment means comprising: said second end is attached onto a fastening pad, said fastening pad having a first side and a second side, said first side having a removable adhesive strip which when removed leaves an adhesive residue thereon for attaching said fastening pad onto a corner of said pick, whereby:

said finger ring, said pick, and said tether are interconnected yet removably attached together.

2. The finger ring interconnected to a pick of claim 1 wherein said finger ring is adjustable in size.

3. The finger ring interconnected to a pick of claim 1 wherein said tether is made from either; fishing line, cloth, string, elastic, rubber, wire, or plastic.

4. The finger ring interconnected to a pick of claim 1 wherein said first attachment means comprising: said first end having an opening for slidably receiving said finger ring there through.

5. The finger ring interconnected to a pick of claim 1 wherein said first attachment means comprising: said first end being manually tied onto said finger ring.

6. A finger ring interconnected to a pick in combination for playing a musical instrument comprising: a finger ring which defines a finger-receiving receptacle there through; a tether having a first end and a second end; and a pick; said first end being removably attached by a first attachment means onto said finger ring and said second end being removably attached by a second attachment means onto said pick,) said second attachment means comprising: said second end being attached onto a gripping member, said gripping member having an internal triangular shaped recess, and said internal triangular shaped recess being of a shape and size to mate with a corner of said pick whereby: when said corner of said pick is inserted into said internal triangular shaped recess, said internal triangular shaped recess frictionally receives and retains said corner of said pick therein in a secure yet removable manner.

7. The finger ring interconnected to a pick of claim 1 wherein said fastening pad is butterfly shaped providing a first wing and a second wing;

whereby:

when said adhesive strip is removed and said corner of said pick is positioned in between each said wing with said first wing being folded over onto said corner of said pick and said second wing, said pick is held there between in a secure manner by said fastening pad and said residue.

8. The finger ring interconnected to a pick of claim 1 wherein said first attachment means comprising: said tether further includes a central area, a first intermediate area and a second intermediate area, said first intermediate area being located between said first end and said central area, said first intermediate area having a first fastener thereon, said first end after being inserted into and throughout said finger-receiving receptacle forms a loop for attaching said finger ring thereon, and said first end is secured in place by said first end being slidably engaged within said first fastener.

9. A finger ring interconnected to a pick in combination for playing a musical instrument comprising: a finger ring which defines a finger-receiving receptacle there through; a tether having a first end and a second end; and a pick; said first end being removably attached by a first attachment means onto said finger ring and said second end being removably attached by a second attachment means onto said pick,) said second attachment means comprising: said tether further includes a central area, a first intermediate area and a second intermediate area, said second intermediate area being located between said second end and said central area, said second intermediate area having a second fastener thereon, said second end after being inserted into and throughout an aperture provided on said pick forms a loop for attaching said pick thereon, and said second end is secured in place by said second end being slidably engaged within said second fastener, thus said tether is variably adjustable in length.

10. The finger ring interconnected to a pick of claim 1 wherein said tether further includes a magnet thereon;

whereby:

said magnet allows a user to magnetically attach said finger ring interconnected to a pick onto a metallic surface for storage purposes when not in use.

11. The finger ring interconnected to a pick of claim 1 further includes said tether being retractable within said finger ring between a retracted position and a non-retracted position;

whereby:

in use the user pulls said tether until said tether is the desired length, said tether when manually released automatically assumes a locked non-retracted position, whereby:

thereafter, when said user initiates a gentle tug on said tether, said tether is automatically released and assumes said retracted position.

* * * * *